US005747665A

United States Patent [19]

Thompson

[11] Patent Number: 5,747,665

[45] Date of Patent: May 5, 1998

[54] TUNGSTEN AS A HYPERGOLIC FUEL GEL ADDITIVE

[75] Inventor: Darren M. Thompson, Madison, Ala.

[73] Assignee: The United States of America as represented by the Secretary of the Army, Washington, D.C.

[21] Appl. No.: 850,732

[22] Filed: May 2, 1997

[51] Int. Cl.[6] ..... C06D 5/00

[52] U.S. Cl. ..... 44/265; 149/20; 149/36; 149/108.2; 60/211; 60/215; 60/216

[58] Field of Search ..... 44/265; 149/20, 149/36, 108.2; 60/215, 216, 211

[56] References Cited

U.S. PATENT DOCUMENTS

| | | | |
|---|---|---|---|
| 3,933,543 | 1/1976 | Madden | 149/21 |
| 4,039,360 | 8/1977 | Allan | 149/36 |
| 4,202,668 | 5/1980 | Sippel et al. | 44/265 |
| 5,133,183 | 7/1992 | Asaoka et al. | 60/204 |
| 5,438,824 | 8/1995 | Asaoka et al. | 60/251 |
| 5,597,947 | 1/1997 | Stephens | 44/268 |

*Primary Examiner*—Alan Diamond
*Assistant Examiner*—Cephia D. Toomer
*Attorney, Agent, or Firm*—Hugh P. Nicholson; Freddie M. Bush

[57] ABSTRACT

Tungsten is added to fuel gels to increase the density specific impulse. Fuel gels contain monomethylhydrazine or other hypergolic liquids well known in the art. The quantity of tungsten employed can vary from 10%–98% weight percent depending on the specific application. The important parameters to consider during formulation are particle size, concentration, combustion efficiency, physical properties, and plume signature. Tungsten particle sizes ranging from 10 microns to 0.5 micron were compared with carbon of 0.24 when burned in air. It is shown that tungsten burns as well as or better than carbon; however, the increased density specific impulse achieved with tungsten as compared with carbon verifies that tungsten as a high energy additive to hypergolic fuel gels is superior. The burning temperature with small particle size tungsten is controlled to yield a plume with minimum signature since all of the tungsten exist in the gaseous state in the exhaust gases thereby yielding an exhaust plume which is transparent as attractive for tactical missiles to avoid detection.

4 Claims, 2 Drawing Sheets

TUNGSTEN AS A HYPERGOLIC FUEL GEL ADDITIVE

DEDICATORY CLAUSE

The invention described herein may be manufactured, used, and licensed by or for the Government for governmental purposes without the payment to me of any royalties thereon.

BACKGROUND OF THE INVENTION

An advantage of gelled fuels is that they can be loaded with solid high energy materials that increase both specific impulse and density impulse. Gel bipropulsion rockets have separate fuel and oxidizer supply systems that cannot interact unless injected into the combustion chamber. The gel bipropulsion rocket, therefore, has essentially inherent insensitive munition (IM) properties. Gel propulsion systems have used fuel gels containing aluminum and carbon.

Several solid materials, such as aluminum and boron, have been used as solid fuels in propulsion systems; however, rocket plume signatures of there materials are unacceptable for minimum signature applications. With few exceptions, Army prefers propulsion systems with minimum signature to decrease launch point detection and increase survivability, to minimize interference with seeks and communications in the battlefield, and to increase kill probability.

SUMMARY OF THE INVENTION

Tungsten is added to fuel gels to increase density specific impulse. Monomethyl hydrazine is a hypergolic liquid which has been used extensively in fuel gels; however, other hypergolic liquids can be used in the fuel gels. The quantity of tungsten depends on the specific application for which the formulation will be used. The usual concentration ranges from 10% to 92% by weight. The important parameters to consider during formulation are particle size, concentration, combustion efficiency, physical properties, and plume signature.

Elemental tungsten has a very high melting point (3410° C.; however, it is quite flammable and has been characterized on material safety data sheets (MSDS) as a flammable solid. Therefore tungsten is oxidized long before it melts. It is a very dense solid material (19.3 g/cc). This high density of tungsten provides two important advantages: it increases the amount of tungsten that can be used in a composition and it increases the density specific impulse. Bigel systems that use monomethyl hydrazine (MMH) can be loaded with aluminum up to 60%. When the volume percentage of the liquid MMH is held constant for this formulation and tungsten is used to replace aluminum, the formulation is composed of 92% tungsten. The ability to put this much solid material into the gel greatly enhances the density specific impulse (density*ISP).

DESCRIPTION OF THE PREFERRED EMBODIMENTS(s)

Tungsten is added to fuel gels to increase density specific impulse. The very dense solid tungsten (19.3 g/cc) with a very high melting point (3410° C.) has the unique property of being oxidized long before it melts. Tungsten is classified on material safety data sheets (MSDS) as a flammable solid. When employing tungsten to increase density specific impulse as disclosed herein, the important parameters to consider during formulation are particle size, concentration, combustion efficiency, physical properties, and plume signature.

Figure 1:
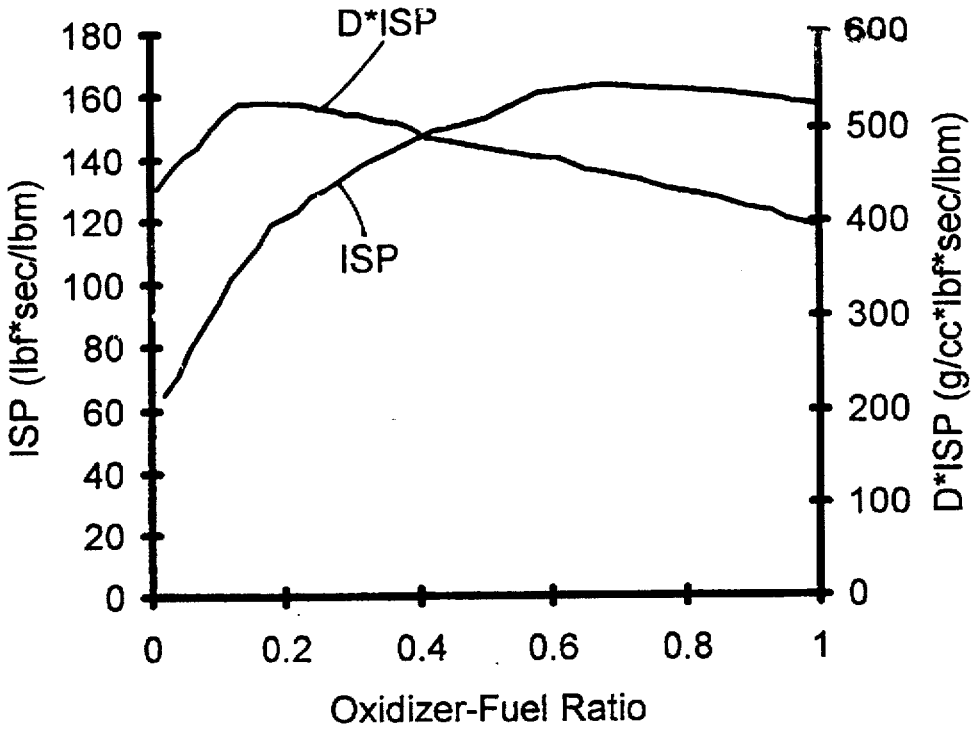
FIG. 1 depicts the comparisons of theoretical specific impulse (ISP) and density specific impulse (*ISP) for tungsten loaded monomethyl hydrazine (MMH) fuels in relation to differing oxidizer: fuel ratios.
Figure 2:
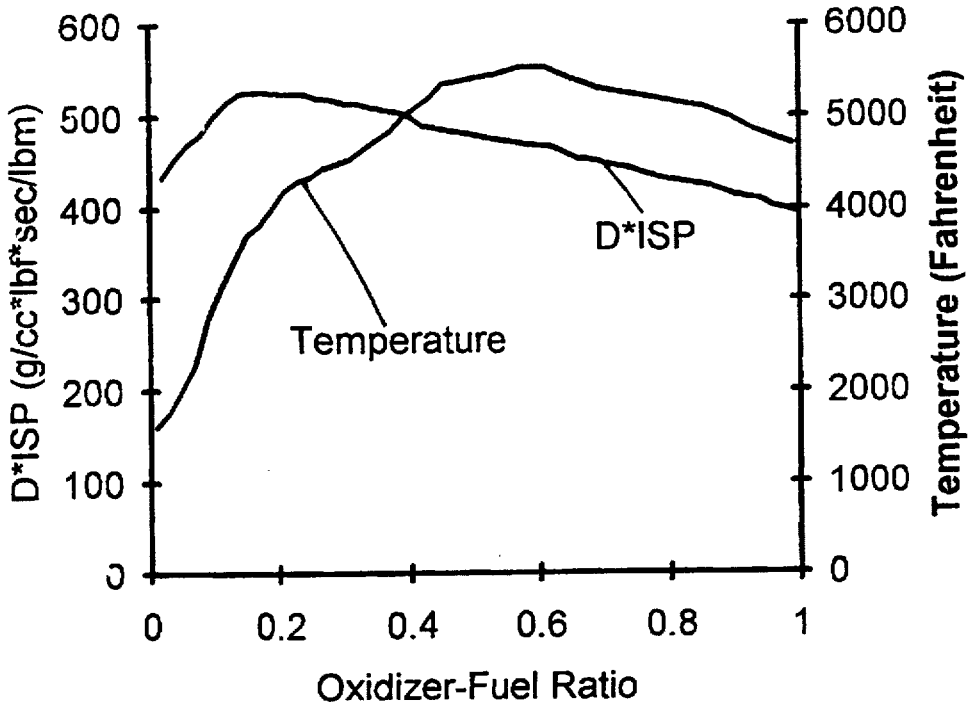
FIG. 2 depicts the relationship between *ISP and combustion chamber temperature at differing oxidizer: fuel ratios for the tungsten loaded MMH fuel gels.

In further reference to the FIGS. 1 and 2 of the drawing, the maximum *ISP at 1000 psi chamber pressure is 530 (g/cc)(lbf*sec/lbm) at an oxidizer: fuel ratio of 0.2, almost 85% of the tungsten is unreacted as it leaves the nozzle. This may be satisfactory for smokey plume formulations but afterburning of the tungsten in the atmosphere makes this solution highly unlikely. However in considering the highest chamber temperature which occurs at 5532° F. and an oxidizer: fuel ratio of 0.6, the optimum stoichiometric ratio is reached thereby achieving no unreacted tungsten in the exhaust gases. This condition results in a minimum signature formulation since all the combustion products of tungsten at the exhaust conditions of the nozzle are gases; therefore, the rocket plume is transparent, an essential requirement for use in tactical missiles to avoid detection.

TABLE 1

Comparison of Tungsten and Carbon Burning in Air

| Particle Size | Material | Burning Temperature (°C.) In Air |
|---|---|---|
| 10 microns | Tungsten | 600–700 |
| 0.5 micron | Tungsten | 400–500 |
| 0.24 micron | Carbon | 600–650 |

Note:
Analysis of burning temperatures determined by TGA (thermogravimetric analysis)
Conclusion: Depending on particle size of material selected, tungsten burns as well as or better than carbon in air.

Example 1 illustrates the use of aluminum, in the form of a finely divided powder, in a fuel gel formulation.

| Ingredient | Function | % By Weight |
|---|---|---|
| hydroxypropyl cellulose | gellant | 1.4 |
| dimethylurea | additive | 0.1 |
| monomethylhydrazine | liquid fuel | 38.5 |
| aluminum powder | metal fuel | 60.0 |
| | Total | 100.0 |

The formulation of Example 1 represents a bigel system using the liquid fuel monomethylhydrazine (MMH) loaded with aluminum up to 60%. When the volume percentage of the liquid MMH is held constant for this formulation and tungsten is used to replace aluminum, the formulation is composed of 92% tungsten. The ability to employ this much solid material into the gel enhances the density specific impulse (density*ISP). The density of tungsten is 19.3 g/cc, and because of its unique burning characteristic in an oxidizing environment, the value of this dense material is recognized by reviewing FIG. 1 of the comparisons of theoretical ISP and *ISP for tungsten loaded MMH fuels in relation to differing oxidizer: fuel ratios. The relationship between *ISP and combustion temperature at differing oxidizer:fuel ratios for tungsten loaded MMH fuel gels as shown in FIG. 2 further emphasizes the value of tungsten as a high energy additive for hypergolic fuel gels.

Example 2 ,set forth hereinbelow, illustrates the use of tungsten finely divided powder, in a fuel gel formulation wherein the tungsten and MMH can be varied in the ratios specified to achieve a wide range of results. For example, when tungsten of 10 microns particle size was burned in air a burning temperature of 600°–700° C. resulted as compared to carbon of 0.24 micron particle size which showed a burning temperature of 600°–650° C. When fuel gel containing tungsten was burned at an oxidizer: fuel ratio of 0.2, almost 85% of the tungsten is unreacted as it leaves the nozzle. This formulation is acceptable for smokey plume formulations but afterburning of the tungsten in the atmosphere is not likely to correct the problem of a smokey rocket plume. For conditions which require a minimum signature formulation, the oxidizer: fuel ratio of 0.6 provides the optimum stoichiometric ratio for the highest chamber temperature which occurs at 5532° F. The optimum stoichiometric ratio results in no unreacted tungsten in the exhaust gases. This condition results in all gaseous products of combustion in the exhaust plume; therefore, the rocket plume is transparent, an essential requirement for use in tactical missile to avoid detection.

| Ingredient | Function | | % By Weight |
|---|---|---|---|
| hydroxypropyl cellulose | gellant | | 1.4 |
| dimethylurea | additive | | 0.1 |
| monomethylhydrazine | liquid fuel | range | (6.5–88.5) |
| tungsten powder | metal fuel | range | (10.0–92.0) |
| | | Total | 100.0 |

The above fuel gel composition is used in a gel bipropulsion system in combination with an oxidizer wherein the fuel gel composition and the oxidizer; typically, inhibited red fuming nitric acid (IRFNA), are injected simultaneously into a combustion chamber from separate supply systems to achieve a hypergolic reaction in said combustion chamber. The benefits derived at the oxidizer: fuel ratios specified hereinabove provides a gel bipropulsion systems for a wide range of uses. The gel bipropulsion system can yield a smokey plume for afterburning of the tungsten in the atmosphere or a transparent plume where it is an essential requirement for use in tactical missiles to avoid detection. The plumes' smokey properties or transparent properties are controlled by the oxidizer: fuel ratios, particle size of tungsten, and the temperature reached in the combustion chamber to thereby control the exhaust conditions, whether products of combustion are in the gaseous state or whether some of the tungsten is in an unreacted state as it leaves the exhaust nozzle of said combustion chamber.

I claim:

1. A thixotropic fuel gel composition comprising:

(i) tungsten having a particle size from about 0.5 micron to about 10 microns which is present in an amount from about 10 weight percent to about 92 weight percent of said thixotropic fuel gel composition;

(ii) a gellant of hydroxypropyl cellulose in an amount of 1.4% by weight;

(iii) an additive of dimethylurea in an amount of 0.1% by weight; and, (iv) a liquid fuel of monomethylhydrazine in an amount from about 6.5 weight percent to about 88.5% weight percent.

2. The thixotropic fuel gel composition as defined in claim 1 wherein said monomethylhydrazine is present in said composition in an amount of about 6.5 weight percent and wherein said tungsten is present in said composition in an amount of about 92.0 weight percent.

3. A gel bipropulsion system comprising the thixotropic fuel gel composition as defined in claim 1 which is contained in a separate supply system for simultaneous injection into a combustion chamber with an oxidizer for simultaneous injection from a separate supply system to achieve a hypergolic reaction, said oxidizer supply and said fuel gel composition being injected at oxidizer:fuel ratios which range from about 0.2 to about 0.6 to achieve a maximum density specific impulse at a 1000 psi combustion chamber pressure for said oxidizer:fuel ratios.

4. The gel bipropulsion system as defined in claim 3 wherein said oxidizer: fuel ratio is 0.6 to provide an optimum stoichiometric ratio to achieve a temperature of about 5532° F. in said combustion chamber to thereby achieve no unreacted tungsten in exhaust gases.

* * * * *